United States Patent [19]

Peniche

[11] 4,214,672

[45] Jul. 29, 1980

[54] CAN STOPPER

[76] Inventor: Hector Peniche, 32-55 Steinway St., Long Island City, N.Y. 11103

[21] Appl. No.: 15,776

[22] Filed: Feb. 28, 1979

[51] Int. Cl.[2] ..... B65D 53/00

[52] U.S. Cl. ..... 220/234; 215/359

[58] Field of Search ..... 220/234, 237, 238, 307; 215/358, 359

[56] References Cited

U.S. PATENT DOCUMENTS 195,849 10/1877 Seybold ..... 215/359

3,326,403 6/1967 Glass ..... 220/234

*Primary Examiner*—George T. Hall

[57] ABSTRACT

A closure or stopper for cans and the like. The closure member includes a triangularly shaped member of elastic material in which there is rotatably mounted an adjusting member. The closure member is first inserted into the standard triangularly shaped opening of a can while the adjusting member is in an inactive position. The adjusting member is then rotated a predetermined angular distance whereby the closure member is sealingly pressed against the walls of the container opening.

7 Claims, 3 Drawing Figures

FIG. 1
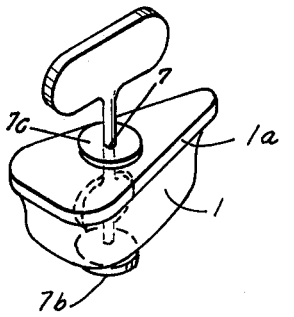
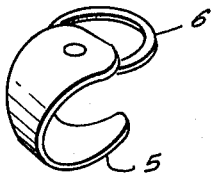
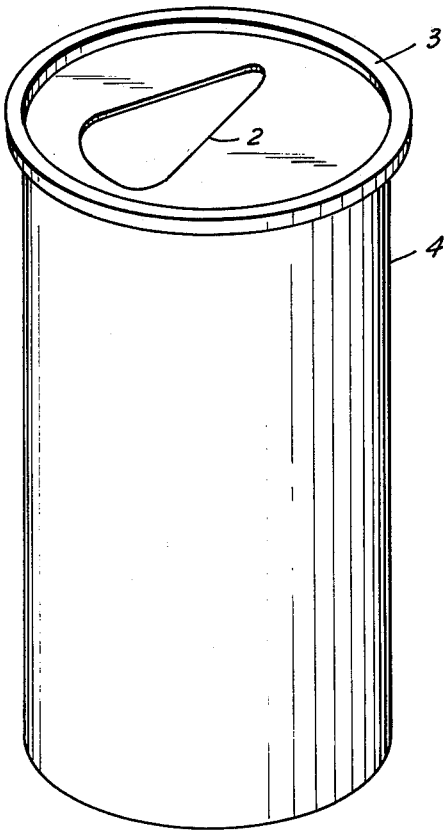
FIG. 2
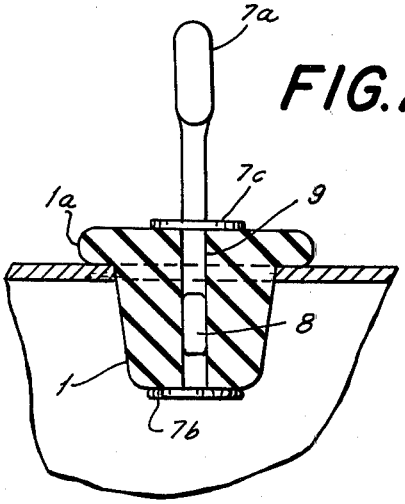
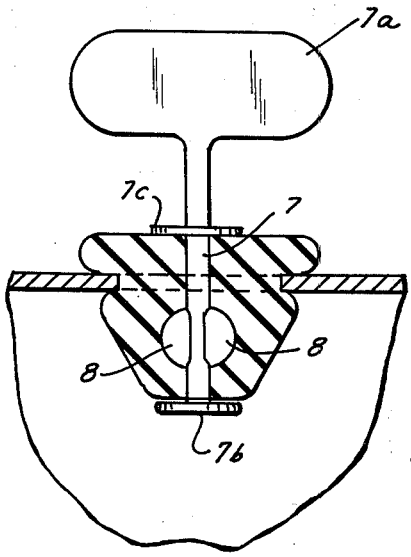
FIG. 3

CAN STOPPER

BACKGROUND OF THE INVENTION

In known closures, e.g. for cans, the sealing pressure is produced on the seal by means of the resilient character of the closure member only. Known closures for jars and bottles do include some means in the form of a screw or a plunger to increase or decrease the closing pressure of the closure member against the internal walls of the bottle or jar. However, such closures have not been found to be suitable for satisfactorily sealing the openings of cans, in particular soda or beer cans. Moreover, the removal of the known closure members for soda or beer cans is quite difficult because of the high pressure that is required by the resilient member against the walls of the opening of the soda can or beer can.

SUMMARY OF THE INVENTION

The present invention relates to a closure for soda or beer cans. Such cans generally have a metal tab with a metal ring, which when pulled off, exposes a triangularly shaped opening in the top of the soda or beer can. It has been quite difficult to properly seal this triangularly shaped opening in the can. According to the invention a closure is provided which is distinguished by an elastic closure element in which there is rotatably mounted an adjusting member or operating member, so that a sealing pressure is produced by this adjusting or operating member after the closure member, consisting of an elastic material such as rubber, has been inserted into the can opening; the operating member is angularly moved thereby increasing the sealing pressure of the elastic material against the walls of the can opening to thereby seal said opening. When it is desired to remove the closure member, the operating member is again turned a predetermined angular distance thereby relieving the pressure against the walls of the can opening to facilitate the removal of the closure member.

BRIEF DESCRIPTION OF THE DRAWING

Various forms of the invention are shown in the drawing, in which:

FIG. 1 is an exploded view illustrating a soda or beer can, the metal tab and ring which has been pulled off the soda can or beer can top, and the closure member together with the operating member forming the subject of this invention, all being illustrated in perspective;

FIG. 2 is a side elevational cross sectional view of the soda or beer can top with a closure member in accordance with the invention inserted therein, wherein the operating member is in the inactive position; and FIG. 3 is a cross sectional elevational view of the soda or beer can top with the closure member inserted therein wherein the operating member is in the active position.

DESCRIPTION OF SPECIFIC EMBODIMENTS

The closure shown in FIGS. 1-3 comprises an elastic closure element 1, preferably made of rubber or a material of equivalent elasticity. The closure element 1 is matingly shaped with respect to the triangularly shaped opening 2 in the top 3 of the soda or beer can 4. The opening 2 is of standard size and shape, that is it is the type of opening that is produced in the soda and beer cans that are generally used by the soda and beer manufacturers of the United States. Such cans generally have a metal tab 5 to which there is attached a ring 6. By pulling the ring 6 the metal tab 5 can be pulled off the top 3 of the soda or beer can 4 thereby exposing a triangularly shaped opening 2. An operating member 7 is rotatably mounted in a bore 9 of the closure element 1. The bore 9 is substantially equidistantly disposed from the three apices of the isosceles triangle which is formed by the plane passing through the top of the closure element 1. The operating member 7 includes a pair of coextensively diametrically opposite radially extending portions 8 which bear against the internal walls of the bore 9. The bore 9 may be cylindrical but can also be elyptical, whereby the longitudinal axis of the elipse coincides with the midsector of the isosceles triangle formed by the top of the closure elment 1. The operating member 7 includes a handle portion 7*a*, adapted to be gripped for turning operating member 7. This operating member 7 is preferably made of metal. A metal washer 7*b* is rigidly secured or freely mounted on the free end of the operating member 7. A second washer 7*c* is coaxially secured or freely mounted on the operating member 7 so as to bear onto the top surface of the closure element 1 as illustrated in FIGS. 2 and 3.

The closure element 1 includes a top flange 1*a* which extends laterally along the upper periphery of the closure element 1 and which acts as a stop when the closure element 1 is inserted into the triangular opening 2.

The closure member of this invention operates as follows:

The closure element 1 is inserted into the can opening 2 by being pressed into it. Since the operating member 7 mounted inside of the bore 9 has the collaterally extending parts 8, it follows, that when the operating member 7 is turned via the handle 7*a* the elastic closure element 1 is forced against the walls of the can opening 2 because it causes the closing element 1 to expand and the elastic material of the closing element 1 is thereby forced outwardly. The closing element 1 is thereby locked into place and the excape of gas or liquid through the opening 2 is prevented. When it is desired to remove the closure or stopper, the operating member 7 is turned in a direction opposite to the original angular rotation thereby easing the internal stress in the closure element 1 and causing a certain shrinking of the closure element 1, whereby the entire closure can be removed from the can opening 2.

In lieu of providing only a circular flange 7*c*, 7*b*, it is contemplated and within the scope of this invention to make either or both of the flange members 7*b*, 7*c* coextensive with the top or bottom of the closure element 1 thereby producing a sturdier and more durable assembly.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A closure or stopper adapted to sealingly close an opening in the top of a beer or soda can, comprising in combination, a closure element made of elastic material and having a cross-section of configuration and shape that mates with the configuration and shape of the opening in the top of said can, said closure element having a bore extending therethrough;

an operating member having a shank portion which is rotatably mounted in said bore; said shank portion having at least one projection laterally extending therefrom the maximum lateral extent of which exceeds the minimum radius of said bore;

whereby when said closure element has been inserted in the can opening and the operating member is rotated a predetermined angular distance said closure element is biased against the walls of the can opening thereby sealingly closing it.

2. The closure or stopper as set forth in claim 1, wherein said can opening and cross-section of said closure element have substantially mating triangular configurations and shapes.

3. The closure or stopper as set forth in claim 2, including at least one washer freely mounted on said shank portion and bearing against the top of said closure element.

4. The closure or stopper as set forth in claim 3, including an additional washer freely mounted on said shank portion and bearing against the bottom of said closure element.

5. The closure or stopper as set forth in claim 4, wherein said washers are rigidly secured to said shank portion.

6. The closure or stopper as set forth in claim 1, wherein said shank portion has a pair of projections laterally extending in diametrically opposite directions.

7. The closure or stopper as set forth in claim 1, wherein there is axially mounted a handle on the shank portion exterior of said closure element.

* * * * *